United States Patent [19]

Skelton

[11] 4,305,216

[45] Dec. 15, 1981

[54] HOLDER FOR VEHICLE SERVICE REMINDER CARD AND THE LIKE

[76] Inventor: Sam Skelton, P.O. Box 205, Ft. Thomas, Ky. 41075

[21] Appl. No.: 35,950

[22] Filed: May 4, 1979

[51] Int. Cl.[3] ..... G09F 3/18

[52] U.S. Cl. ..... 40/10 B; 40/159; 40/591

[58] Field of Search ..... 40/158 R, 159, 10 A, 40/10 B, 10, 591

[56] References Cited

U.S. PATENT DOCUMENTS

| | | | |
|---|---|---|---|
| 1,681,375 | 8/1928 | Shook | 40/10 A |
| 2,153,149 | 4/1939 | MacHarg | 40/152 |
| 2,725,913 | 12/1955 | Horwin | 40/159 |
| 2,837,854 | 6/1958 | Bing et al. | 40/152 |
| 3,197,905 | 8/1965 | Witte et al. | 40/158 R |
| 3,370,365 | 2/1968 | Vosbikian | 40/10 R |
| 3,826,026 | 7/1974 | Bevan | 40/10 B |
| 3,950,580 | 4/1976 | Boudet | 40/10 R |

FOREIGN PATENT DOCUMENTS

| | | | |
|---|---|---|---|
| 2302850 | 1/1973 | France | 40/10 D |
| 2299974 | 9/1976 | France | 40/159 |

*Primary Examiner*—Gene Mancene
*Assistant Examiner*—Wenceslao J. Contreras
*Attorney, Agent, or Firm*—Frost & Jacobs

[57] ABSTRACT

A card holder for visibly and removably mounting on an interior vehicle surface a card bearing maintenance reminder information. The holder includes a film-like sheet containing a transparent central area dimensioned for viewing the information on the card, and a strip of adhesive material surrounding the transparent area for mounting the holder on the surface, such that the holder forms a card-accepting pocket dimensioned to snugly hold the card removably in place when mounted on the vehicle surface.

4 Claims, 4 Drawing Figures

HOLDER FOR VEHICLE SERVICE REMINDER CARD AND THE LIKE

SUMMARY OF THE INVENTION

Vehicle owners often have the need to determine when periodic maintenance services such as oil changes, lubrication, tire rotation and the like were last performed on the vehicle, in order to plan for periodic preventive maintenance. It has been the practice for operators of vehicle service facilities to include periodic maintenance reminders in the form of a small reminder sticker adhered to the inside of the vehicle door, or located in the engine compartment. Often such reminders are removed from the view of the vehicle operator, and go unnoticed, defeating their intended purpose. It is also common for such reminders to be lost or displaced, or obscured by oil or grease.

One solution has been suggested in U.S. Pat. No. 3,011,279 issued Dec. 5, 1961 to K. H. Severson, and U.S. Pat. No. 3,319,369 issued May 16, 1967 to the same inventor, where a substantially rigid plastic holder is adhered to a portion of the vehicle visible to the operator, and configured to contain a small removable card bearing relevant maintenance data. Such devices have not proven entirely acceptable to vehicle service personnel, and consequently have not been widely employed as a simple means for communicating periodic maintenance information to the vehicle operator and insuring return business for the service station operator.

The vehicle service reminder card holder of the present invention comprises a simple, inexpensive, easily operated device for mounting a rectangular card bearing the required maintenance data. In a preferred embodiment, the card holder comprises a trapezoidal-shaped flexible transparent plastic sheet having a separable strip along the margin of three sides of the holder which can be removed to expose a layer of adhesive material for attaching the holder to a suitable portion of the vehicle interior, such as the dashboard or sun visor. With the holder in place, a transparent pocket is formed into which the rectangular card bearing the required maintenance information can be easily inserted or removed as required, thus keeping the maintenance information in full view of the vehicle operator. The open end of the holder pocket is beveled so that a corner of the information bearing card is exposed to facilitate manual grasping.

DETAILED DESCRIPTION

Figure 1:
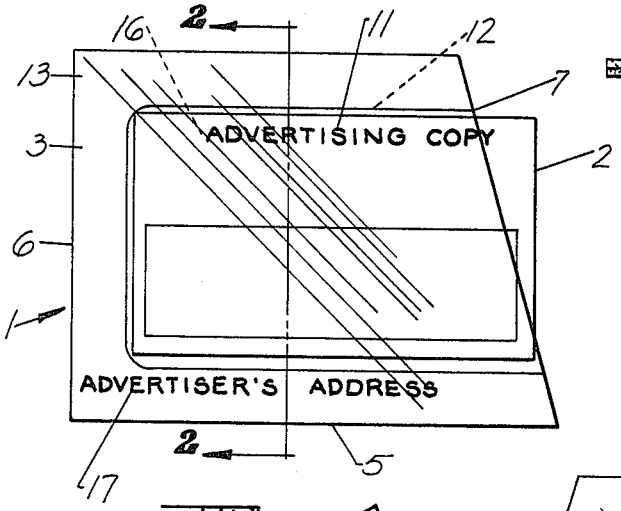
FIG. 1 is a front view of the card holder of the present invention with the reminder card in place.

FIG. 1 illustrates a front view of the vehicle service reminder card holder, shown generally at 1, of the present invention with a typical service reminder card 2 in place. Holder 1 comprises a generally trapezoidal-shaped sheet 3 having substantially parallel upper and lower margins 4 and 5, respectively. The left hand margin 6 is arranged substantially perpendicular to the upper and lower margins, while the right hand margin 7 is beveled so that upper margin 4 is approximately seventy-five percent (75%) the length of lower margin 5 in order that the upper corner of service reminder card 2 is exposed to facilitate manual grasping.

Figure 2:
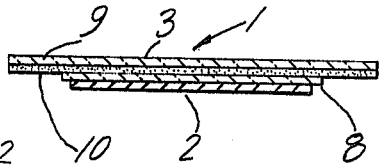
FIG. 2 is a fragmentary cross sectional view taken along section line 2—2 of FIG. 1.

As best shown in FIG. 2, sheet 3 comprises a lower film or layer 8 releasably secured to upper film or layer 9 by means of a suitable transparent adhesive 10 sandwiched between lower layer 8 and upper layer 9. In a preferred embodiment, both layers 8 and 9 will be constructed of a transparent flexible material, such as an acrylic plastic or the like, in order that the information bearing portion of service reminder card 2 may be clearly visible in the central portion of holder 1 designated 11 in FIG. 1. Furthermore, the material chosen for holder 1, such as acrylic plastic or the like, will generally have the ability to withstand temperatures commonly encountered in an automobile interior without yellowing, cracking, or otherwise deteriorating. In the preferred embodiment, upper and lower layers 8 and 9 comprise 2 mil sheets of acrylic plastic. This arrangement permits maximum visibility of card 2 while maintaining the desired degree of flexibility to holder 1.

Lower layer 8 contains a score line or die cut 12 passing completely or partially through lower layer 8, and extending around three sides of central transparent area 11 parallel to and spaced from outer margins 4, 5 and 6, in order to form a C-shaped border portion 13. In general, adhesive 10 is fixedly secured to upper layer 9 but removably secured to lower layer 8 to facilitate removal of border portion 13.

Figure 3:
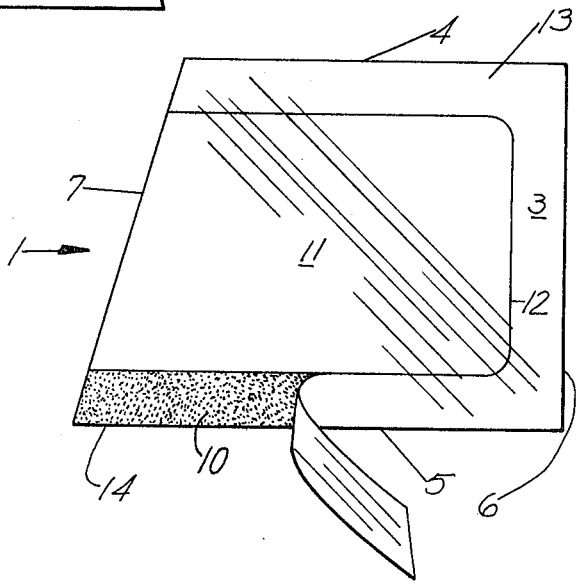
FIG. 3 is a rear view of the card holder showing the margin strip partially removed.

As best shown in the rear view of holder 1 illustrated in FIG. 3, the border portion 13 of lower layer 8 can be peeled from upper layer 9 along score line 12 to reveal a pressure sensitive adhesive portion 14 lying between score line 12 and outer margins 4, 5 and 6. Holder 1 may then be inverted and adhesive margin 14 pressed firmly against the desired surface within the vehicle, such as sun visor 15 illustrated in FIG. 4, to firmly mount holder 1 in place.

Figure 4:
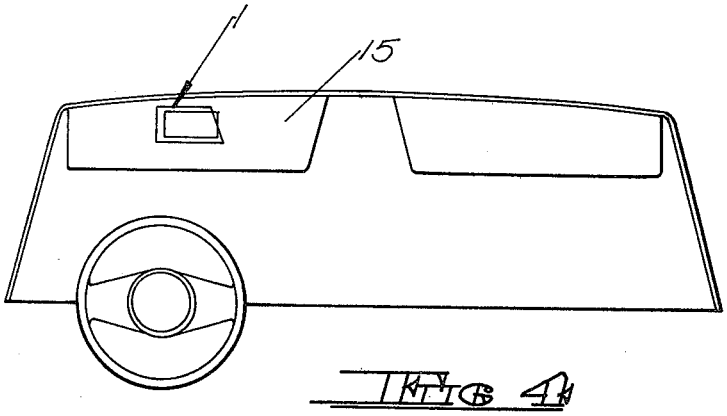
FIG. 4 is a perspective view illustrating the card holder of the present invention mounted in place on a vehicle sun visor.

As shown in FIG. 4, holder 1 will customarily be attached to the vehicle surface with the lower margin 5 downwardly, in order to prevent service reminder card 2 from becoming displaced from the pocket formed between transparent area 11 and the outer face of the vehicle mounting surface. Furthermore the pocket formed by score line 12 will be dimensioned slightly larger than service reminder card 2, in order to snugly hold the card firmly in place. It will be noted that the flaccid nature of holder 1 resulting from flexible layers 8 and 9 permit the holder to conform to non-planar or irregularly shaped mounting surfaces, such as curved vehicle dash boards and the like. Furthermore, while the preferred orientation of holder 1 is illustrated in FIG. 4, it will be understood that holder 1 may be mounted in any other orientation as particular circumstances require.

Service reminder card 2 will generally be of the same size as a $2\times3\frac{1}{2}$ inch standard business card, so as to snugly fit within the pocket of holder 1 with the upper right hand corner extending beyond beveled margin 7 to facilitate inserting and removing card 2 from the holder. However, it will be understood that holder 1 and card 2 may be dimensioned of any size to meet particular requirements.

As illustrated in FIG. 1, service reminder card 2 may be provided with appropriate indicia to provide spaces where the date and/or mileage associated with specific maintenance services such as lubrication, oil change and the like may be entered. In addition, card 2 may be provided with appropriate advertising information as at 16 to insure repeat business for the service merchant, and holder 1 may be provided with appropriate advertising information as at 17 to designate the merchant furnishing the holders.

It will be understood that various changes in the details, materials, steps and arrangements of parts, which have been herein described and illustrated in order to explain the nature of the invention, may be made by those skilled in the art within the principle and scope of the invention as expressed in the appended claims. For example, while for purposes of an exemplary showing, holder 1 has been described and illustrated as comprising a pair of laminated layers bound together by an appropriate transparent adhesive to form sheet 3, it will be understood that holder 1 may be formed from a single layer of flexible transparent material bearing an appropriate adhesive boarder pattern 13, which may be protected by a paper or plastic peel strip as required.

The embodiments of the invention in which an exclusive property or privilege is claimed are as follows:

1. A substantially trapezoidal-shaped card holder for visibly and removably mounting an information bearing card of substantially rectangular shape on a surface comprising:

a film-like sheet containing a generally rectangular transparent central area dimensioned for viewing the information on the card;

a strip of adhesive material surrounding three sides of said transparent area for mounting said holder on the surface; and means associated with said sheet comprising a beveled edge along one margin of said holder for grasping a corner of the card when said holder is mounted on the surface with the card in place to facilitate grasping the card;

said holder forming a card-accepting pocket dimensioned to snugly hold the card removably in place between said sheet and the surface when said holder is mounted on the surface.

2. The holder according to claim 1 wherein said adhesive strip is protected by a thin peelable layer which can be removed to expose said adhesive material prior to mounting said holder on the surface.

3. A card holder for visibly and removably mounting an information bearing card of substantially rectangular shape on a surface comprising:

a first film-like transparent flexible sheet of substantially trapezoidal outline, said sheet including top, bottom and side margins, said bottom margin being longer than said top margin such that one of said side margins is bevel-shaped;

a second film-like transparent flexible sheet of like outline to said first sheet;

adhesive means attached to said first sheet for releasably attaching said sheets together;

a C-shaped score line extending at least partially through said second sheet, said score line having a first leg portion spaced from said upper margin and extending from said bevel-shaped margin to a first point spaced from said other side margin, a second leg spaced from said other side margin and extending from said first point to a second point spaced from said lower margin, and a third leg spaced from said lower margin and extending from said second point to said bevel-shaped margin, the distance between said first and third legs being dimensioned slightly greater than the width of the card, the distance between said second leg and said bevel-shaped margin being such that a corner of the card will be exposed for grasping when said holder is mounted on the surface, the outermost area of said second sheet between said score line and said top, bottom and side margins forming a border which can be easily separated from said first sheet to expose a strip of said adhesive means;

whereby said holder can be attached to the surface by said adhesive means to form a pocket between said holder and the surface for holding and displaying the card.

4. The holder according to claim 3 including a substantially rectangular card dimensioned to be snugly received within said pocket such that a corner of said card extends beyond said bevel-shaped margin for manual grasping.

* * * * *